US007066764B2

(12) United States Patent
Bolouri-Saransar

(10) Patent No.: US 7,066,764 B2
(45) Date of Patent: Jun. 27, 2006

(54) HINGED TERMINATION DEVICE FOR A MULTICONNECTOR

(76) Inventor: Masud Bolouri-Saransar, Malmbjergsvej 17, st. th., DK-2850 Nærum (DK)

( * ) Notice: Subject to any disclaimer, the term of this patent is extended or adjusted under 35 U.S.C. 154(b) by 0 days.

(21) Appl. No.: 10/168,605

(22) PCT Filed: Dec. 29, 2000 (Under 37 CFR 1.47)

(86) PCT No.: PCT/DK00/00740

§ 371 (c)(1), (2), (4) Date: Feb. 23, 2004

(87) PCT Pub. No.: WO01/50548

PCT Pub. Date: Jul. 12, 2001

(65) Prior Publication Data

US 2005/0032412 A1 Feb. 10, 2005

(30) Foreign Application Priority Data

Dec. 30, 1999 (DK) ..... 1999 01877

(51) Int. Cl.
*H01R 4/24* (2006.01)

(52) U.S. Cl. ..... 439/409

(58) Field of Classification Search ..... 439/409, 439/410, 404, 417
See application file for complete search history.

(56) References Cited

U.S. PATENT DOCUMENTS 4,426,125 A * 1/1984 Crawford ..... 439/404
4,550,971 A * 11/1985 Gentric ..... 439/404
5,464,352 A * 11/1995 Van Emmerick ..... 439/404
5,681,182 A * 10/1997 Reichle ..... 439/417
5,685,733 A * 11/1997 Janczak ..... 439/395
5,947,761 A 9/1999 Pepe ..... 439/409
6,062,896 A * 5/2000 Huang ..... 439/405
6,254,421 B1 * 7/2001 Denovich et al. ..... 439/409

FOREIGN PATENT DOCUMENTS

| | | |
|---|---|---|
| EP | 0825678 | 2/1998 |
| EP | 0907226 | 4/1999 |
| WO | 9900873 | 1/1999 |

* cited by examiner

*Primary Examiner*—Neil Abrams

(74) *Attorney, Agent, or Firm*—Ladas & Parry

(57) ABSTRACT

A termination device comprising a body having a plurality of protruding terminals and a cover having slits so that, upon closing, the cover guides and forces wires respectively associated with the terminals down into respective terminals and respective slits of the cover to provide an electrical connection between the wires and the terminals, and wherein the cover is hinged to the body such that the wires may be positioned correctly in an open position of the cover, and such that the wires are in the respective terminals in a closed position of the cover, characterized in that a first number of terminals distributed in a direction crosswise of the hinge axis is greater than a second number of terminals distributed in a direction parallel to the hinge axis and that distances from the hinge axis to the terminals respectively vary substantially evenly between smallest and greatest of the distances.

10 Claims, 3 Drawing Sheets

HINGED TERMINATION DEVICE FOR A MULTICONNECTOR

Figure 1:
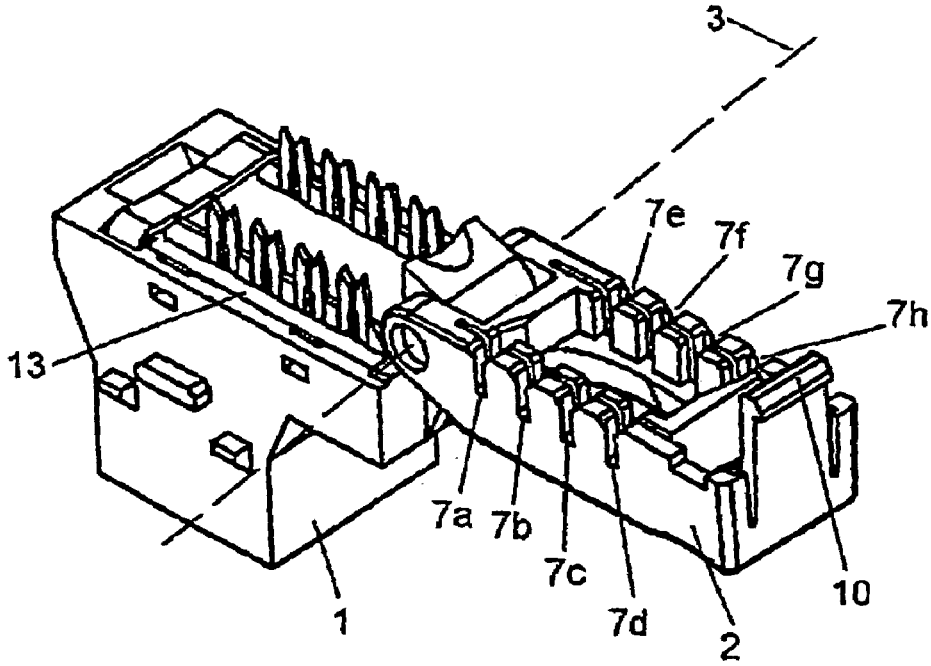

The invention relates to a termination device e.g. for a multiconnector and comprising a plurality of protruding terminals and a cover which, upon closing of the device, is adapted to guide and force a wire associated with each terminal down into the terminal to provide an electrical connection between the wire and the terminal.

A multiconnector having a closure device of the above-mentioned type is known e.g. from European Patent Application No. 907 226. With this and other known techniques, the wires must first be arranged in a cover which is a loose part relative to the part containing the terminals, so that it is difficult to guide the cover and the terminals relative to each other during closing. The operation is additionally impeded in that it is normally necessary to use a special tool, because the known covers are adapted such that all terminals are affected simultaneously for insertion of a wire.

The object of the invention is to provide a termination device which may be closed more easily and without the use of tools relative to the prior art. The invention is not restricted to multiconnectors, but will be explained below in relation to multiconnectors.

This object is achieved in that the cover is hinged to the multiconnector such that the wires may be positioned correctly in an open position, and such that the wires are in place in the respective terminals in a closed position, and that the distance from the hinge axis to the terminals varies substantially evenly distributed between a smallest distance and a greatest distance.

When the terminals are differently spaced from the hinge axis, the various terminals will gradually cooperate with the respective wires as the cover is closed around the hinge axis. Thus, it is not so that all terminals have to be expanded at the same time, and it is therefore easier to force the wires down into the terminals in turn. The hinge also means that the parts are better positioned relative to each other during the closing movement. An optimum distribution of the applied forces during the closing movement is achieved in that all terminals are differently spaced from the hinge axis.

Since terminals and wires will describe a circular arc movement around the hinge axis when the cover is closed, it is expedient that the terminals are elastic transversely to the hinge axis. Another embodiment may be that the slit between the terminals for receiving a wire is arc-shaped and positioned concentrically around the hinge axis.

Before the multiconnector is closed, the wires are arranged in position in the cover, which has grooves for receiving an associated wire. The grooves may have a width which corresponds to the thickness of the wire so that the wires are fixed in the groove, but compensation for the above-mentioned arc-shaped movement may also be achieved in that the grooves close to the hinge axis are wider than the grooves which are positioned further away from the hinge axis. Preferably, the grooves are open toward a pair of opposed sides of the cover so that the wire ends can protrude freely substantially in parallel with the hinge axis, which makes it very easy to cut off the wires so that they are flush with said sides before the cover is closed.

In a preferred embodiment, a through hole is provided from the top of the cover to the bottom of the cover, and as the grooves are preferably positioned at the bottom of the cover, a cable may be inserted from the top, following which the wires of the cable may be arranged in the grooves at the bottom of the cover. Alternatively, another of the sides of the cover may be provided with a hole for receiving a cable.

Figure 2:
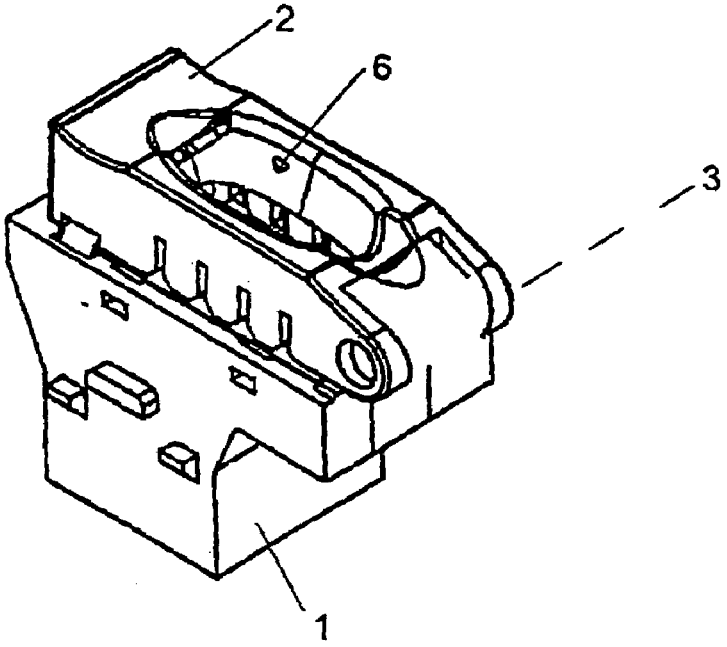
Figure 3:
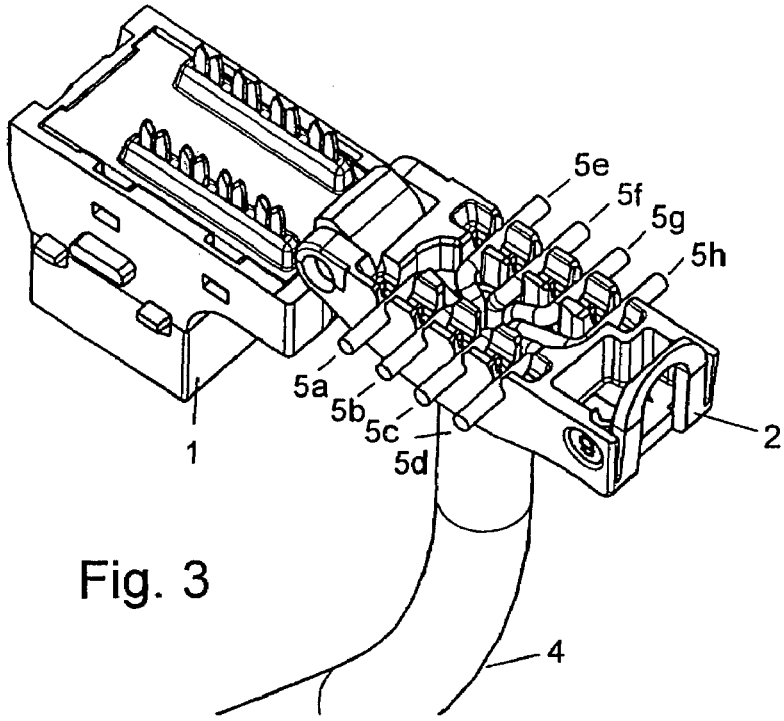
Figure 4:
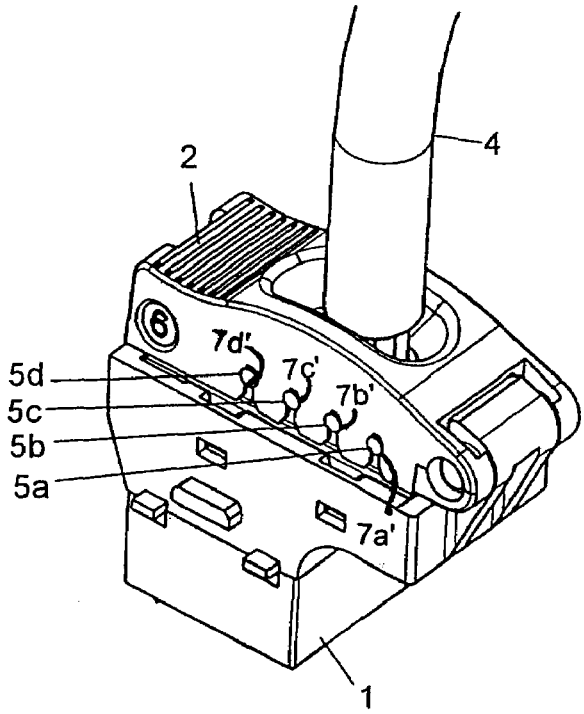
Figure 6:
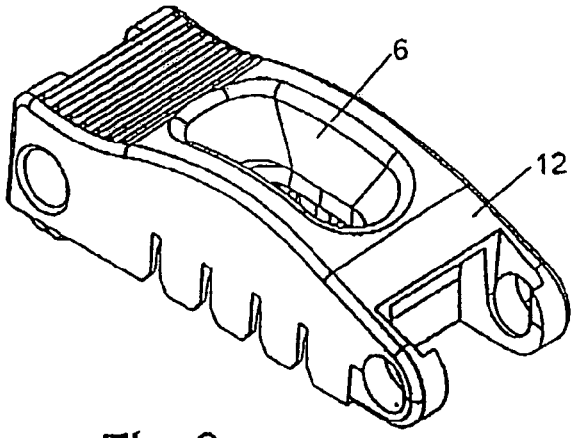
Figure 7:
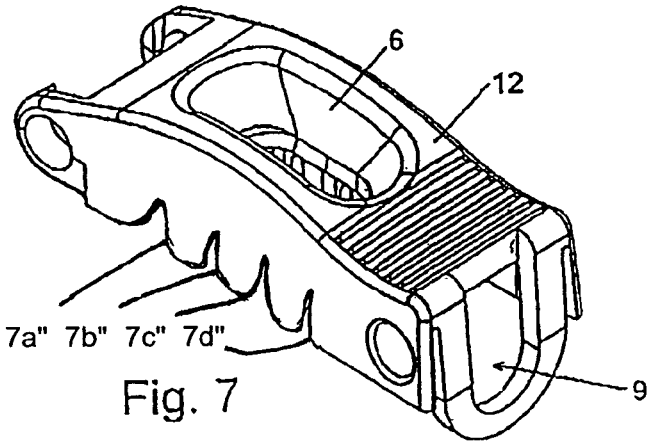
Figure 5:
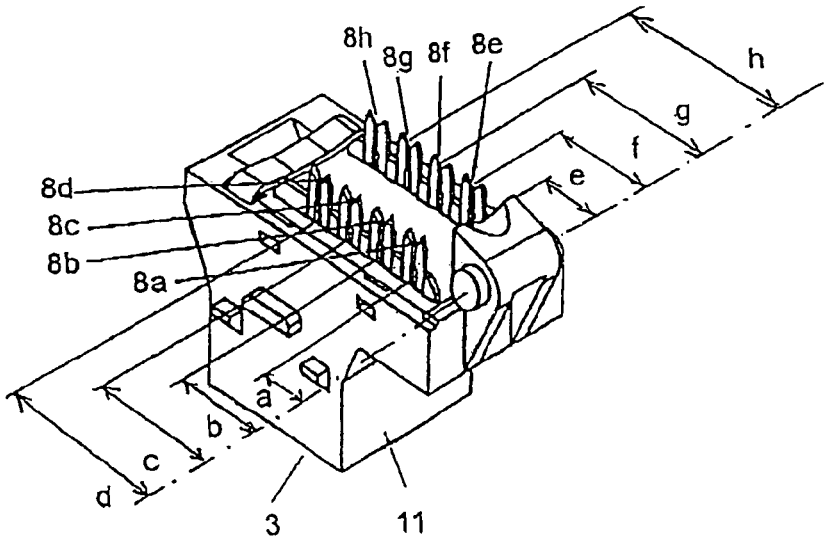

The invention will be explained more fully by the following description of some embodiments with reference to the drawing, in which FIGS. 1 and 2 show a first embodiment of the termination device according to the invention, FIGS. 3 and 4 show the termination device shown in FIGS. 1 and 2, but with an inserted cable containing a plurality of wires, while FIGS. 5–7 show a second embodiment of the termination device according to the invention.

FIG. 1 shows a housing 1 and a cover 2 which is rotatably mounted on the housing 1 about an axis of rotation 3. The housing and the cover may form a multiconnector, so that the bottom of the housing might be adapted to receive a counterpart of a multiconnector, but the housing 1 might also have downwardly extending solder pins for mounting on a printed circuit board. It is also conceivable that the bottom of the housing 1 is provided with a cover corresponding to the cover 2 with associated terminals. The embodiments will be described below under the designation multiconnector.

FIG. 2 shows the parts shown in FIG. 1 in a closed position, while FIGS. 3 and 4 show the same as FIGS. 1 and 2, but with an inserted cable 4. In the embodiment shown, the cable 4 may contain up to eight wires which are shown at 5*a*–*h*. The cable is inserted into an opening 6 in the cover, as will be seen best in FIG. 2, and the outer jacket is removed so that the individual wires protrude freely. Then, the wires may be arranged in respective slits 7*a*–*h*. The open end of the slits facing upwards in FIG. 1 is bevelled so that it is easy to introduce the wires 5*a*–*h* into the terminals. The terminals are also positioned such that it is easy to shorten the wires with cutting pliers, as is indicated in FIG. 4.

FIG. 5 shows another housing 11, and the associated cover 12 can be seen in FIGS. 6 and 7. In FIG. 5, two axially spaced rows of the terminals are designated 8*a*–8*d*, 8*e*–8*h* and the distances a–h drawn in the figure show the distances of the respective terminals crosswise from the axis of rotation 3. According to the invention, the terminals are differently spaced from the axis of rotation 3, and in a preferred embodiment all distances are mutually different. This means that the closing force may be reduced relative to the prior art where all wires are forced down into the respective slits at the same time. The invention also covers the embodiment that the terminals are just arranged at two mutually different distances from the axis of rotation 3.

It would be appreciated that the terminals and/or the individual wires 5*a*–*e* will describe a circular are movement around the axis of rotation 3 when the cover is closed, and one would therefore believe that it might cause problems to prevent in particular the innermost wires from getting squeezed during the closing movement. This is prevented in several ways. For one thing, it will be seen that the uppermost opening to the terminals is V-shaped so that the respective wire is moved down into the terminal during the closing movement, but according to the invention the terminals 8*a*–*e* may also be resilient transversely to the axis of rotation 3. Even though it is preferred that the slits 7*a*–*e* are so narrow that they can fix the wires temporarily during the closing movement, it is also conceivable that in particular the innermost slits 7*a* and 7*e* are wider than the outermost ones 7*d* and 7*h*. Another solution shown in FIG. 4 is that portions of the slits 7*a*', 7*b*', 7*c*', 7*d*' in the cover about shortened wires 5*a*, 5*b*, 5*c*, 5*d* are arc-shaped and substantially aligned in a direction crosswise to the axis of rotation (hinge axis) 3. A further option is indicated in FIG. 5. The protective rails, which are shown at 13 in FIG. 1, are removed in FIG. 5 to show that, at the tip, the terminals have a wire-receiving part and below this a wide slit, which means that the terminals are elastic in a direction transversely to the axis of rotation 3. However, it has been found in practice that there is no appreciable need for compensation for the circular are movement of the wires. When the device according to the invention is intended for the mounting of copper wires in tinned terminals, the invention also utilizes the circumstance that a certain flow of said metals takes place to ensure a good electrical connection.

The cover 12 shown in FIGS. 6 and 7 also has a through hole 6 for a cable, but, as will appear from FIG. 7, a side of the cover may also comprise a hole 9 for receiving a cable. In the embodiment shown in FIG. 7, the lowermost part of the wall, in which the hole 9 is provided, serves as a locking boss 10 which locks the cover 2 to the housing 1 in the position shown in FIG. 2, and the grooves 7*a*", 7*b*", 7*c*" and 7*d* closer to the hinge axis are -wider than the grooves further away from the hinge axis, measured transversely to the hinge axis. It will be appreciated that the cover may be hinged and formed in other ways so that the cable may be inserted and relieved in any direction.

The invention claimed is:

1. A termination device comprising a body having a plurality of protruding terminals and a cover having slits so that, upon closing, the cover guides and forces wires respectively associated with the terminals down into respective terminals and respective slits of the cover to provide an electrical connection between the wires and the terminals, and wherein the cover is hinged to the body such that the wires may be positioned correctly in an open position of the cover, and such that the wires are in the respective terminals in a closed position of the cover, characterized in that a first number of terminals distributed in a direction crosswise of the hinge axis is greater than a second number of terminals distributed in a direction parallel to the hinge axis and that distances from the hinge axis to the terminals respectively vary substantially evenly between smallest and greatest of the distances, the terminals being in at least two evenly spaced and staggered rows with at least three terminals in each row.

2. A device according to claim 1, characterized in that the terminals are elastically movable transversely to the hinge axis.

3. A device according to claim 2, characterized in that portions of the slits for receiving a wire are arc-shaped and substantially aligned with the hinge axis in the direction crosswise of the hinge axis.

4. A device according to claim 1, characterized in that the cover has grooves for receiving an associated wire and for guiding the wire when the cover is closed.

5. A device according to claim 4, characterized in that the grooves have a width corresponding to the thickness of the wires.

6. A device according to claim 4, characterized in that the grooves close to the hinge axis are wider than the grooves further away from the hinge axis, measured transversely to the hinge axis.

7. A device according to claim 4, characterized in that the grooves are open out toward a pair of opposed sides of the cover.

8. A device according to claim 4, characterized in that at least one of the sides of the cover has a hole for receiving a cable which contains said wires.

9. A termination device, comprising a plurality of protruding terminals and a cover which, upon closing of the device, is adapted to guide and force a wire associated with each terminal down into the terminal to provide an electrical connection between the wire and the terminal, and wherein the cover is hinged to the device such that the wires may be positioned correctly in an open position, and such that the wires are in place in the respective terminals in a closed position, characterized in that a first number of terminals distributed in directions crosswise of the hinge axis is greater than a second number of terminals distributed in direction parallel to said axis and that the distance from the hinge axis to the terminals varies substantially evenly distributed between a smallest distance and a greatest distance, characterized in that the grooves are positioned at the bottom of the cover, and that the cover has a through hole from top to bottom for receiving a cable which contains said wires.

10. A termination device comprising a body having a plurality of protruding terminals and a cover having slits so that, upon closing, the cover guides and forces wires respectively associated with the terminals down into respective terminals and respective slits of the cover to provide an electrical connection between the wires and the terminals, and wherein the cover is hinged to the body such that the wires may be positioned correctly in an open position of the cover, and such that the wires are in the respective terminals in a closed position of the cover, characterized in that a first number of terminals distributed in a direction crosswise of the hinge axis is greater than a second number of terminals distributed in a direction parallel to the hinge axis and that distances from the hinge axis to the terminals of the first and second numbers are evenly staggered, the terminals being in at least two evenly spaced and staggered rows with at least three terminals in each row.

* * * * *